US006564871B1

(12) United States Patent
Roberts

(10) Patent No.: US 6,564,871 B1
(45) **Date of Patent: *May 20, 2003**

(54) HIGH PRESSURE PERMANENT PACKER

(75) Inventor: William M. Roberts, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/679,108

(22) Filed: Oct. 4, 2000

Related U.S. Application Data

(63) Continuation-in-part of application No. 09/302,982, filed on Apr. 30, 1999, and a continuation-in-part of application No. 09/302,738, filed on Apr. 30, 1999, now Pat. No. 6,164,377.

(60) Provisional application No. 60/157,439, filed on Oct. 4, 1999.

(51) Int. Cl.[7] ..... E21B 7/08

(52) U.S. Cl. ..... 166/313; 166/117.6; 166/120; 166/134

(58) Field of Search ..... 166/380, 387, 166/117.6, 118, 120, 134

(56) References Cited

U.S. PATENT DOCUMENTS

| | | | | | |
|---|---|---|---|---|---|
| 3,638,723 | A | | 2/1972 | Carroll | 166/215 |
| 3,736,984 | A | | 6/1973 | Garrett | 166/208 |
| 4,285,399 | A | | 8/1981 | Holland et al. | 166/113 |
| 4,304,299 | A | | 12/1981 | Holland et al. | 166/255 |
| 4,349,071 | A | * | 9/1982 | Fish | 166/124 |
| 5,048,613 | A | | 9/1991 | Shilling | 166/387 |
| 5,129,453 | A | | 7/1992 | Greenlee | 166/119 |
| 5,154,231 | A | | 10/1992 | Bailey et al. | 166/298 |
| 5,194,859 | A | | 3/1993 | Warren | 340/853.4 |
| 5,210,533 | A | | 5/1993 | Summers et al. | 340/853.4 |
| 5,398,754 | A | | 3/1995 | Dinhoble | 166/117.6 |
| 5,409,060 | A | | 4/1995 | Carter | 166/237 |
| 5,454,430 | A | | 10/1995 | Kennedy et al. | 166/50 |
| 5,488,989 | A | | 2/1996 | Lesing et al. | 166/255 |
| 5,560,426 | A | | 10/1996 | Trahan et al. | 166/120 |
| 5,564,503 | A | | 10/1996 | Longbottom et al. | 166/313 |
| 5,579,829 | A | | 12/1996 | Comeau et al. | 166/117.6 |
| 5,704,437 | A | | 1/1998 | Murray | 175/61 |
| 5,735,350 | A | | 4/1998 | Longbottom et al. | 166/313 |
| 5,740,864 | A | | 4/1998 | De Hoedt et al. | 166/387 |
| 5,775,428 | A | | 7/1998 | Davis et al. | 166/381 |
| 5,839,515 | A | * | 11/1998 | Yuan et al. | 166/387 |
| 5,871,046 | A | | 2/1999 | Robison | 166/241.1 |
| 5,957,209 | A | | 9/1999 | Burleson et al. | 166/380 |
| 5,992,523 | A | | 11/1999 | Burleson et al. | 166/297 |
| 6,019,173 | A | | 2/2000 | Saurer et al. | 166/98 |
| 6,112,811 | A | * | 9/2000 | Kilgore et al. | 166/134 |
| 6,164,377 | A | | 12/2000 | Roberts | 166/118 |
| 6,305,474 | B1 | * | 10/2001 | Roberts et al. | 166/313 |

FOREIGN PATENT DOCUMENTS

| | | | |
|---|---|---|---|
| GB | 2 271 791 A | 4/1994 | E21B/4/18 |
| GB | 2 293 187 A | 3/1996 | E21B/7/06 |
| WO | WO 94/29563 | 12/1994 | E21B/7/08 |

* cited by examiner

*Primary Examiner*—William Neuder
(74) *Attorney, Agent, or Firm*—Conley Rose, P.C.

(57) ABSTRACT

A packer for use in extreme service applications comprises a radially expandable packing element, a plurality of slip members above the packing element and a plurality of slip members below the packing element. The slip members are each provided with corresponding setting cones disposed adjacent thereto for radially expanding the slips. In addition, a scoop for use in extreme service application includes a double slot-and-pin locking mechanism for engaging the scoop and lock ring retainer.

17 Claims, 6 Drawing Sheets

HIGH PRESSURE PERMANENT PACKER

RELATED APPLICATIONS

This application claims benefit of U.S. Ser. No. 60/157,439, filed Oct. 4, 1999 and entitled "High Pressure Permanent Packer". and is a Continuation In Part of U.S. Ser. No. 09/302,738, filed Apr. 30, 1999 U.S. Pat. No. 6,164,377 and entitled Downhole Packer System and 09/302,982, filed Apr. 30, 1999 and entitled "Scoop For Use With An Anchor System For Supporting a Whipstock," each of which is incorporated herein by reference.

TECHNICAL FIELD OF THE INVENTION

The present invention relates generally to an apparatus for supporting and distributing the load in a downhole tool. More particularly, the present invention relates to extreme service applications, employing a two slot-and-pin engagement, a high pressure permanent packer, and a plurality of slip elements that distribute the load across many points on the casing, thereby lowering the localized stress on the casing wall and reducing the chance of failure.

BACKGROUND OF THE INVENTION

Once a petroleum well has been drilled and cased, it is often necessary or desired to drill one or more additional wells that branch off, or deviate, from the first well. Such multilateral wells are typically directed toward different parts of the surrounding formation, with the intent of increasing the output of the well. Because the location.of the target formation typically falls-within a known azimuthal range, it is desirable to control the initial orientation of the deviation fairly precisely.

In order to drill a new borehole that extends outside an existing cased wellbore, the usual practice is to use a work string to run and set an anchored whipstock. The upper end of the whipstock comprises an inclined face. The inclined face guides a window milling bit laterally with respect to the casing axis as the bit is lowered, so that it cuts a window in the casing. The lower end of the whipstock is adapted to engage the anchor in a locking manner that prevents both axial and rotation movement.

It has been found that conventional whipstock supports may be susceptible to small but not insignificant amounts of rotational movement. Hence, it is desired to provide an anchor and whipstock setting apparatus that effectively prevent the whipstock from rotating. It is further desired to provide a system that can set the packer and anchor the whipstock in a single trip. It is further desired to provide an effective whipstock support that can be run in and set using conventional wireline methods.

Furthermore, in prior art devices, disengagement of the whipstock from the orienting key is typically prevented by a shear pin or similar device. The load capacity of this device limits the amount of load that can be placed on the tool. Hence, it is further desired to provide a key element that resists unintentional disengagement while allowing a greater downhole load to be supported by the tool.

In extreme service applications, such as high pressure environments (defined herein as pressures greater than 15,000 psia), it has been found that when conventional anchor slip arrangements are used, the load is distributed against the casing through the slips in such a way that the casing may fail. Hence, it is desired to provide an anchor slip arrangement that reduces the risk of this type of casing failure.

In addition, relative rotation of the components of prior art devices is typically resisted by a key or straight spline. The separation of duties (resisting torsional movement, resisting axial movement and orienting) in the prior art, and the performance these duties by separate mechanisms resulted in a tool that was relatively complex and susceptible to a variety of failure modes. Hence, it is desirable to provide a tool that combines performance of these duties in single, robust device.

SUMMARY OF THE INVENTION

On embodiment of the present invention provides an anchor and whipstock setting apparatus that effectively prevents the whipstock from rotating. In this embodiment, the tool includes a frangible slip ring that includes a tongue-and-groove interface with the bottom sub of the tool, so as to resist rotation about the tool axis when the slips engage the casing.

The present invention further provides a key, or scoop, that resists unintentional disengagement of the stinger from the key element. The preferred scoop includes a two part locking device that includes at least one, and preferably at least three, pin engaging slots. The preferred scoop comprises inner and outer concentric tubular members, each including at least one pin engaging slot. In this manner, the key element provides a single orientation, while simultaneously providing axial support at multiple points around the azimuth of the tool and allowing greater loads to be supported.

In some embodiments, the present invention provides an apparatus that allows anchoring and orienting a whipstock in a well casing on a single trip of a running string into and out of the casing or using two trips with wireline tools.

In extreme service applications, such as high pressure environments, an alternative embodiment of the present invention may be employed, comprising a double slot-and-pin locking engagement, a high pressure permanent packer, and a plurality of slip elements of equal axial length that distribute the load across many points on the casing.

BRIEF DESCRIPTION OF THE DRAWINGS

For a detailed description of the preferred embodiments of the present invention, reference will now be made to the Figures, wherein.

Throughout the following description, the terms "above" and "below" are used to denote the relative position of certain components with respect to the distance to the surface of the well, measured along the wellbore path. Thus, where an item is described as above another, it is intended to mean that the first item is closer to the surface and the second, lower item is closer to the borehole bottom.

DETAILED DESCRIPTION OF THE PREFERRED EMBODIMENTS

Figure 1A:
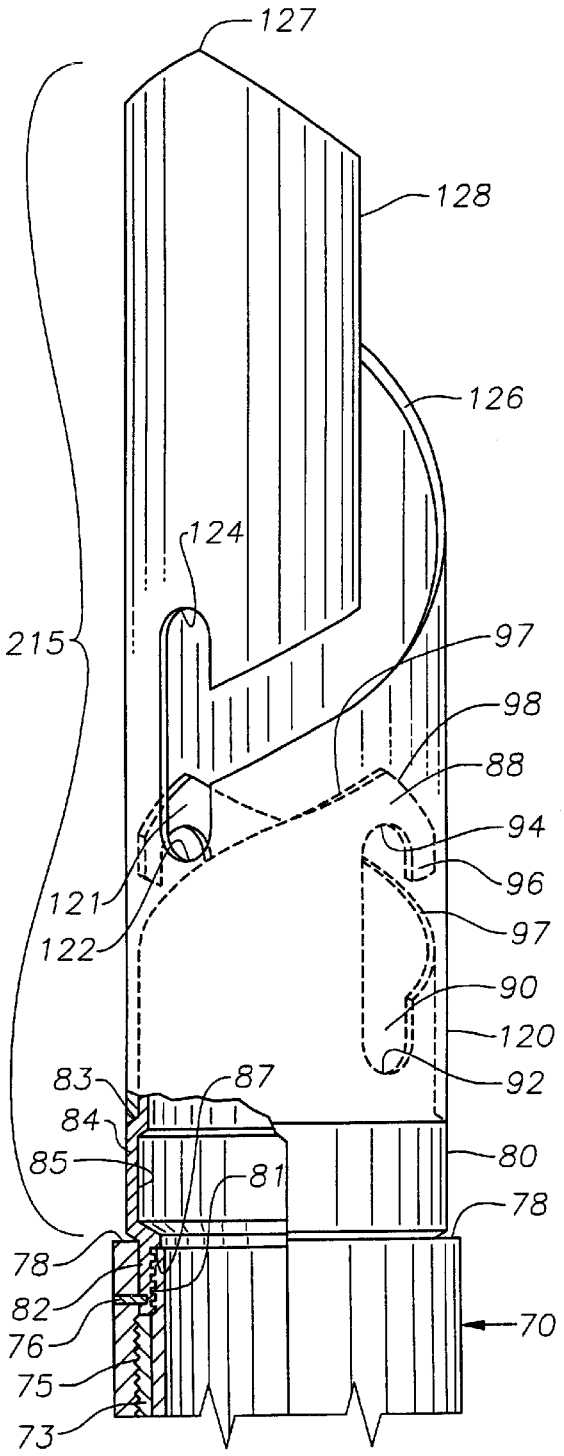
FIG. 1 is a partial cutaway side view of a preferred embodiment of the present invention.
Figure 1B:
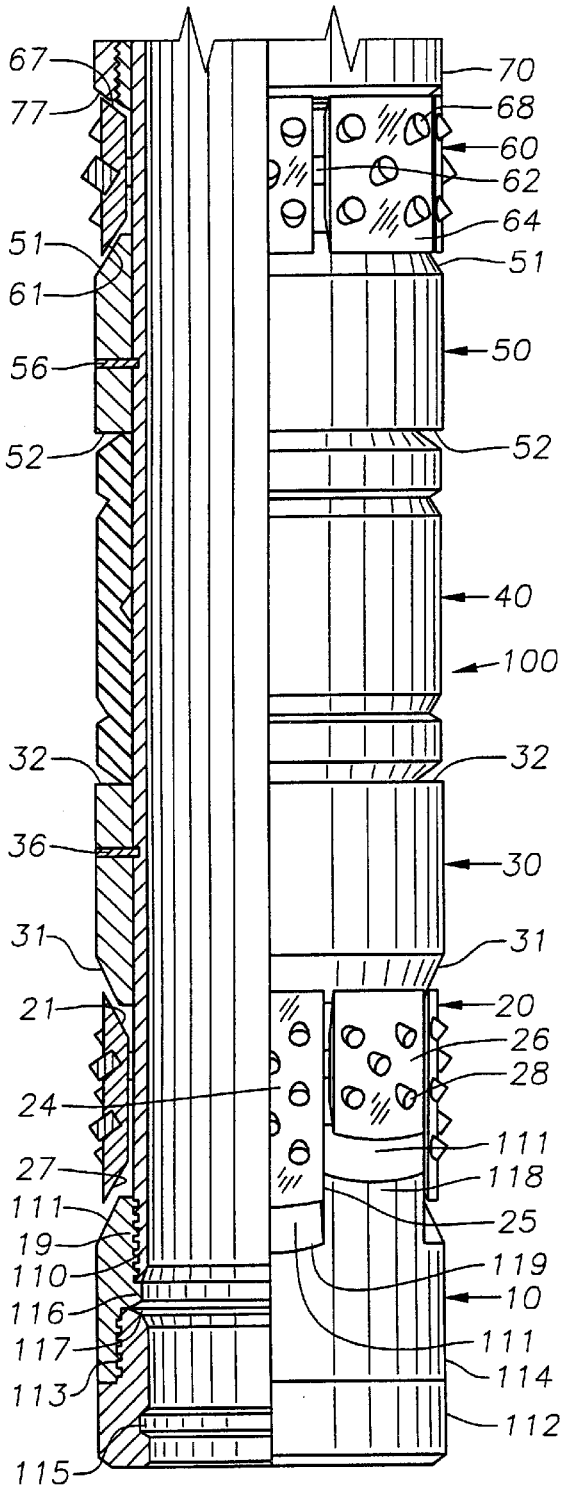

Referring initially to FIG. 1 and beginning at the lower end of the tool, the present whipstock setting tool 100 preferably includes a bottom sub 10, lower slip member 20, lower cone 30, packer assembly 40, upper cone 50, upper slip member 60, lock ring retainer 70, and a scoop 215. Scoop 215 preferably comprises an inner hook portion 80 and an outer hook portion 120. In addition, a mandrel 110, is rigidly affixed to and extends between bottom sub 10 and inner hook portion 80.

Bottom sub 10 preferably comprises first and second members 112, 114, respectively, which are threaded together at 113. First bottom sub member 112 defines a lower annular channel 115. Second bottom sub member 114 includes a shoulder 116 at its lower end such that an upper annular channel 117 is defined between first and second members 112, 114. At its upper end, second bottom sub member 114 includes tongue and groove sections 118, 119 respectively. Each section 118, 119 preferably includes a camming surface 111 at its upper end. Surfaces 111 are preferably planar. Second bottom sub member 114 is rigidly affixed to mandrel 110 at threads 19.

Figure 2:
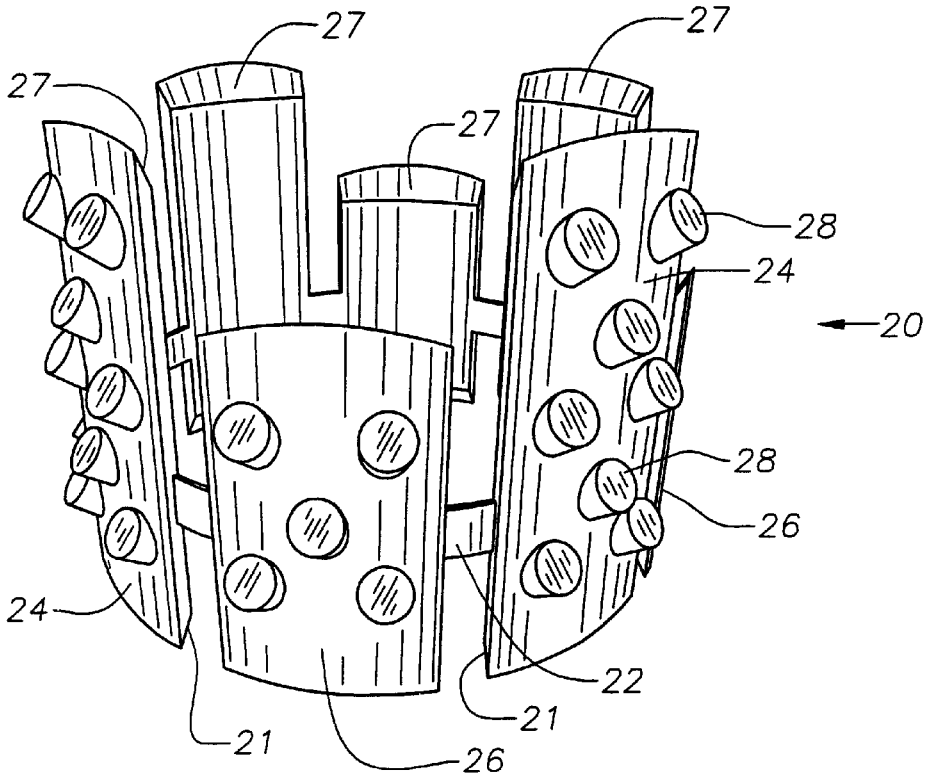
FIG. 2 is a perspective view of the lower slip member of the present invention.

Referring now to FIGS. 1 and 2, lower slip member 20 initially comprises a continuous ring 22 having alternating tongue and groove sections 24, 26, respectively, positioned around its circumference. Each section 24, 26 preferably includes a frustoconical camming surface 21 at its upper end and a planar camming surface 27 at its lower end. Each planar camming surface 27 is adapted to engage a corresponding camming surface 111 on a bottom sub groove or tongue section 119, 118 respectively. In this manner, a region of axial overlap between lower slip member 20 and bottom sub 10 is provided. In this region, an interface 25 is provided between each tongue 24 of the slip member and the adjacent tongues 118 of the bottom sub. Interfaces 25 provide bearing surfaces that allow the transmission of torque between lower slip member 20 and bottom sub 10, as described in detail below.

In an alternative embodiment, slip pads 24, 26 have equal axial lengths, but are still provided with planar camming surface 27. Correspondingly, sections 118, 119 of bottom sub 110 have equal axial lengths and are still provided with planar camming surfaces 111. Particularly in large diameter permanent packers, this configuration provides sufficient torque resistance for many operations.

Still referring to FIGS. 1 and 2, ring 22 may be scored between adjacent pads 24, 26, to facilitate fracture of the ring 22 as described below. The alternating tongue and groove pads 24, 26 each preferably include a plurality of tungsten carbide inserts 28. As best seen in FIG. 1, inserts 28 preferably comprise generally cylindrical slugs that are mounted with their longitudinal axes inclined with respect to the tool axis and their faces oriented downward and radially outward. In an alternative preferred embodiment, one or more of the carbide inserts are rotated so that their faces are oriented more or less in a circumferential direction. Most preferably, at least two of the slip pads having at least some of their inserts oriented with a circumferential component and inserts on separate pads have opposite circumferential directions, i.e. counter-clockwise versus clockwise. While a preferred configuration for the inserts is shown, it will be understood that any insert shape can be used. In alternative embodiment, grooves cut in the outer surface of the slips pads, in either a circumferential or longitudinal direction, or both, can be used in place of or in combination with the carbide inserts.

Referring again to FIG. 1, cones 30 and 50 can be any suitable configuration, such as are generally known in the art. In one embodiment, lower cone 30 includes a frustoconical camming surface 31 at its lower end and a compression surface 32 at its upper end. Correspondingly, upper cone 50 includes a frustoconical camming surface 51 at its upper end and a compression surface 52 at its lower end. In the tool's initial configuration, each cone 30, 50 is preferably held in position relative to mandrel 110 by means of one or more shear pins or screws 36, 56, respectively.

Packer assembly 40 is disposed between compression surfaces 32 and 52. Packer assembly 40 can be any suitable configuration and composition, including an elastomeric body that is preferably, but not necessarily, supported by a knitted wire mesh, or a "petal basket" configuration, such as are known in the art. In an alternative embodiment, packer assembly 40 is replaced with an alternative biasing means, such as a coil spring, Belleville springs, or the like, or is eliminated altogether.

Above upper cone 50, upper slip member 60 is held in place by lock ring retainer 70. Like lower slip member 20, upper slip member 60 preferably includes a ring 62 that supports a plurality of slip pads 64. Each slip pad 64 includes a lower frustoconical canuning surface 61 at its lower end and an upper frustoconical camming surface 67 at its upper end. Each slip pad preferably also includes a plurality of tungsten carbide inserts 68 affixed to its outer surface, with the end face of each insert preferably oriented upward and radially outward.

Lock ring retainer 70 includes a camming surface 77 at its lower end, a threaded surface 75 on its inner surface, and an annular bearing surface 78 at its upper end. A lock ring or ratchet ring 73 has an outer surface that engages threaded surface 75 and an inner ratchet surface that engages a corresponding ratchet surface on the outer surface of mandrel 110. Both ratchet surfaces preferably comprise a plurality of teeth or grooves capable of resisting relative axial movement, such as are known in the art. In the tool's initial configuration, lock ring retainer 70 is preferably prevented from rotating by one or more shear pins or screws 76, which engage inner hook portion 80. Inner hook portion 80, in turn, is threaded onto the upper end of mandrel 110 at threads 81 as described below.

Figure 3:
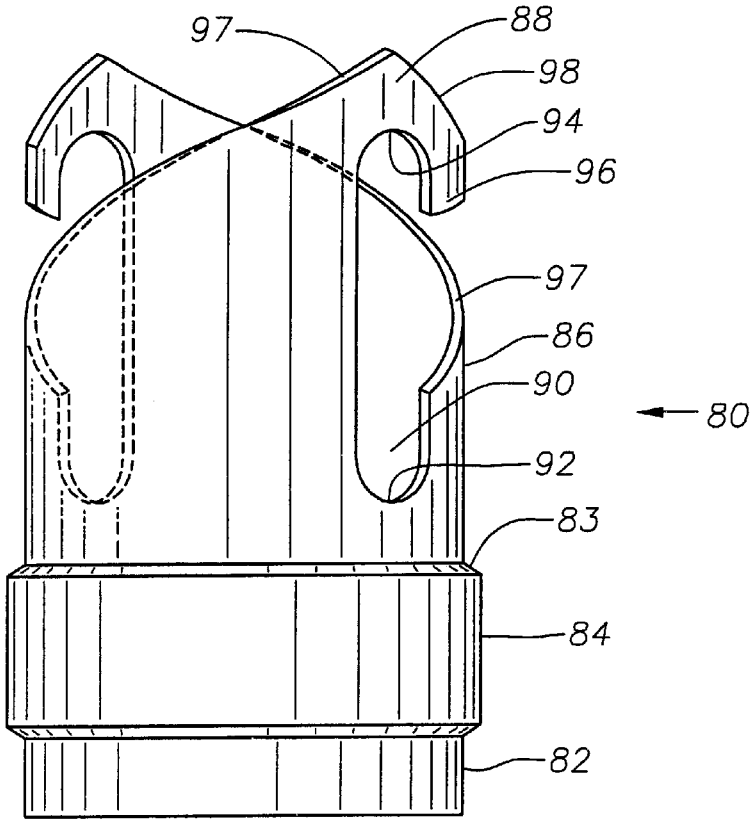
FIG. 3 is a side view of the inner locking device of the present invention.

Referring now to FIGS. 1 and 3, inner hook portion 80 comprises a generally cylindrical tube, having an engagement portion 82, an enlarged diameter portion 84, and a latch portion 86. Engagement portion 82 preferably includes female threads 81 for engaging mating threads on the upper end of mandrel 110. Shear pin(s) 76 preferably also engage portion 82. Enlarged diameter portion 84 defines an outer annular shoulder 83, an inner annular channel 85, and an inner annular lip 87, which preferably engages the upper end of mandrel 110.

Still referring to FIG. 3, the latch portion of inner hook portion 80 preferably comprises a pair of hooks 88, each of which generally resembles an inverted "J." Specifically, each hook 88 includes an elongate slot 90, which is generally parallel to the tool axis and has lower and upper slot ends 92, 94, respectively. Upper slot end 94 is defined by a finger 96, which includes a left inclined edge 97 and a right inclined edge 98. The left inclined edge 97 of each hook extends downward in a clockwise direction until it intersects the lower slot end 92 of the adjacent hook. It will be understood that, while hooks 88 are 180 degrees apart in a preferred embodiment, the configuration described with respect to hooks 88 can be altered to include any number of hooks evenly or unevenly spaced about the body of inner hook portion 80, limited only by space constraints.

Referring again to FIG. 1, in which inner hook portion 80 is shown partially in phantom, outer hook portion 120 is sized to fit snugly over the outside diameter of inner hook portion 80, and to rest on outer annular shoulder 83. In this embodiment, outer hook portion 120 includes a single elongate slot 121, which is generally parallel to the tool axis and includes lower and upper slot ends 122, 124, respectively. The upper edge of outer hook portion 120 includes a helical inclined edge 126, which spirals upward from the right side (as drawn) of slot 121, through approximately 360 degrees until it reaches an apex 127. From apex 127, the upper edge of outer hook portion 120 spirals downward through approximately 40 degrees before terminating at a substantially longitudinal guide surface 128. In this manner, outer hook portion defines an orienting key structure that is capable of receiving and thereby orienting a suitably adapted stinger in a single orientation.

As can be appreciated from FIG. 1, inner hook portion 80 and outer hook portion 120 are configured such that when assembled, slots 90 in inner hook portion 80 are axially offset from slot 121 in outer hook portion 120. In addition slots 90, which in one preferred embodiment are positioned 180° apart, are oriented approximately perpendicularly to a radius from the tool axis through the center of slot 121. Inner hook portion 80 and outer hook portion 120 are preferably rigidly affixed together in the desired orientation by welding at a plurality of points (not shown) around their circumference. Alternatively, they may be fasted together by any suitable means, or may be made as an integral piece, if desired.

It will be understood from the foregoing that scoop 215 is capable of serving three functions: orienting a tool, providing axial support, and providing rotational support (resisting rotation). All three functions can be served by a single hook alone, such as that of outer hook portion 120. The additional, or supplemental, hooks provided in the preferred embodiment merely distribute the axial and rotational loads and are not vital to operation of the invention.

Figure 4A:
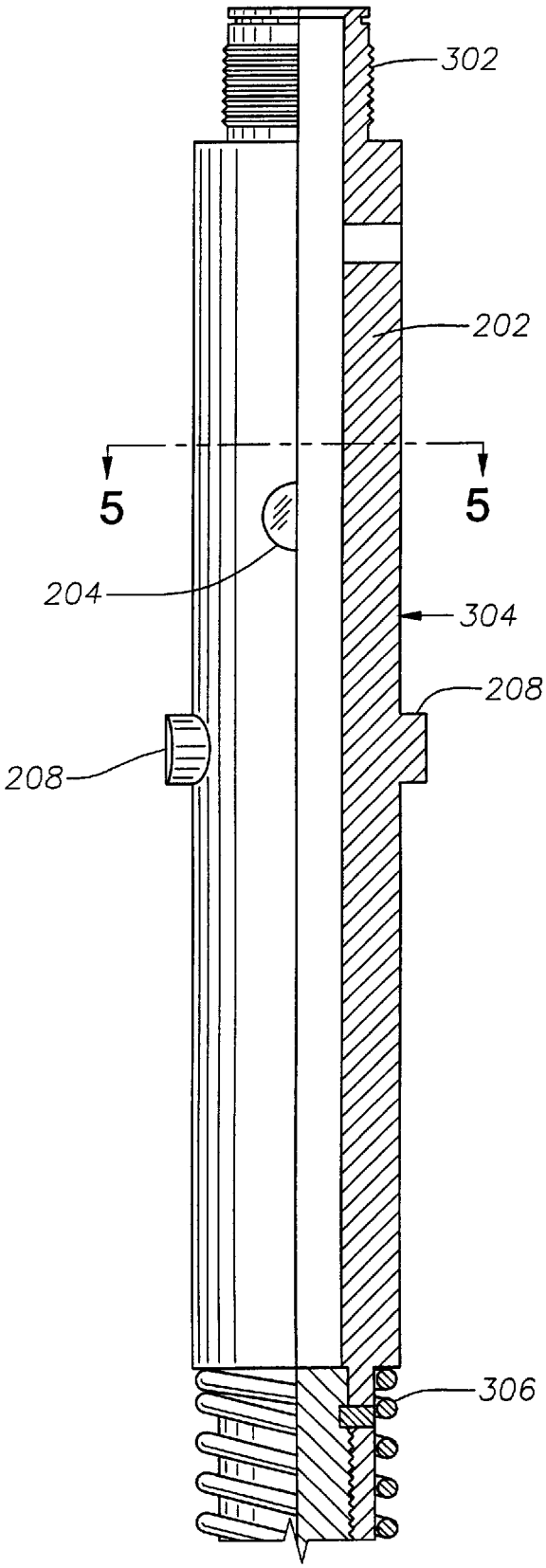
FIG. 4 is a side view of the latch down mechanism that engages the locking device shown in FIG. 1.
Figure 4B:
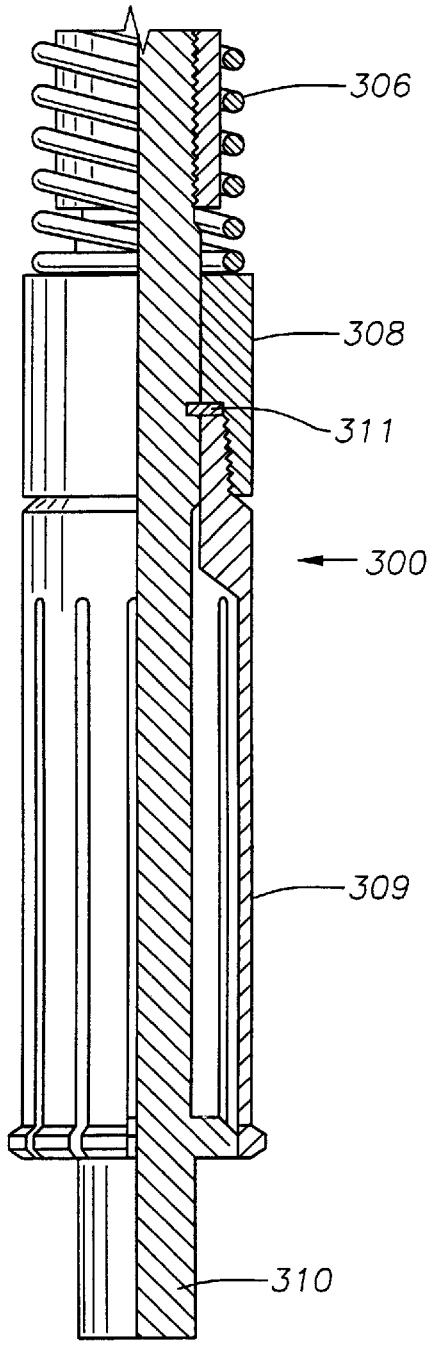
Figure 5:
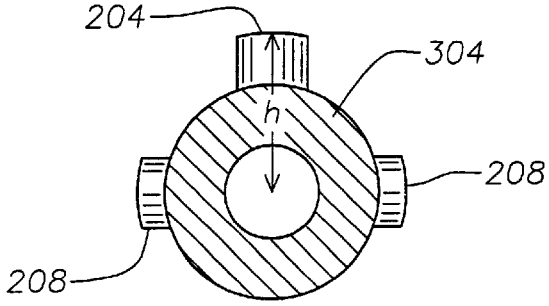
FIG. 5 is a cross-sectional view taken along the lines 5—5 of FIG. 4.

Referring now to FIGS. 4 and 5, a latch-down mechanism 300 such as may be used with the present invention may comprise a threaded connection 302, a stinger 304, a spring 306, a shear ring retainer 308, which retains a shear ring 311, a collet mechanism 309, and a collet support 310. With the exception of stinger 304, the components of latch down mechanism 300 are essentially analogous to those of a conventional latch down mechanism and will not be explained in detail. Stinger 304 is adapted to engage scoop 215 and includes a tubular body 202 having a plurality of pins 204, 208, 208 extending radially therefrom. The outer diameter of body 202 is preferably sized to fit closely within the inner diameter of inner hook portion 80. Pins 204, 208, 208 are preferably integral with body 202 and are arranged so that their axial and azimuthal positions correspond to the positions of the three slots 121, 90, 90. The radial height h of each pin, as measured from the tool axis to the outer surface of the pin, is set to correspond to the radius of the outer surface of the hook that it will engage. Hence, the height of pin 204 is greater than the height of pins 208, because it engages slot 121 and has a height approximately equal to the radius of the outer surface of outer hook portion 120. Correspondingly, pins 208 have a height corresponding approximately to the radius of the outer surface of inner hook portion 80. Because they engage the supplemental slots 90, pins 208 are sometimes herein referred to as supplemental pins.

The slots 121, 90 of scoop 215 are preferably sufficiently axially spaced apart that pin 204 engages and is oriented by outer hook portion 120 before or simultaneously with the engagement of pins 208 inner hook portion 80. This is important in the preferred embodiment because the bisymmetry of inner hook portion 80 gives two possible positions, 180° apart, in which the stinger could be oriented. By ensuring that the stinger is oriented solely by outer hook portion 120, which has only one possible engaged orientation, the correct orientation of the stinger, and hence of the whipstock, is ensured. It will be understood that the number of hooks and slots in outer portion 120 can vary from 1 to five or more, and is constrained only by space and cost limitations. Likewise, a single hook on inner portion 80 could be used to orient a stinger, while one or more supplemental hooks in outer portion 120 subsequently engage additional pins on the stinger. Alternatively, as stated above, the supplemental hooks can be eliminated, leaving only the orienting hook portion to provide all of the axial and rotational support. In any event, it is desirable to have only a single, first-engaged orientation slot or key, which ensures that only a single final orientation of the stinger can be obtained. When all of the pins reach the proper rotational and longitudinal orientation, they can carry tensile, compressive, and left and right hand rotational forces. Rotation is resisted only when pins 204, 208 engage the upper or lower ends of their respective slots.

Operation

Operation of the present tool will be described first with respect to a one-trip drill string operation, and then with respect to a multi-trip wireline operation. In the one-trip context when it is desired to orient and set a whipstock, the present tool is placed in engagement with the lower end of a setting tool that includes latch down mechanism 300 and a ram (not shown). Specifically, latch down mechanism 300 is advanced into scoop 215 until first pin 204 engages the upper edge 126 of outer portion 120 and then all three pins 204, 208 engage their respective slots. The scoop and associated tool below it are advanced axially until pins 204, 208 engage the upper ends 124, 94 of their respective slots. The present tool is then lowered through the casing to the desired depth and oriented to the desired orientation.

Figure 6:
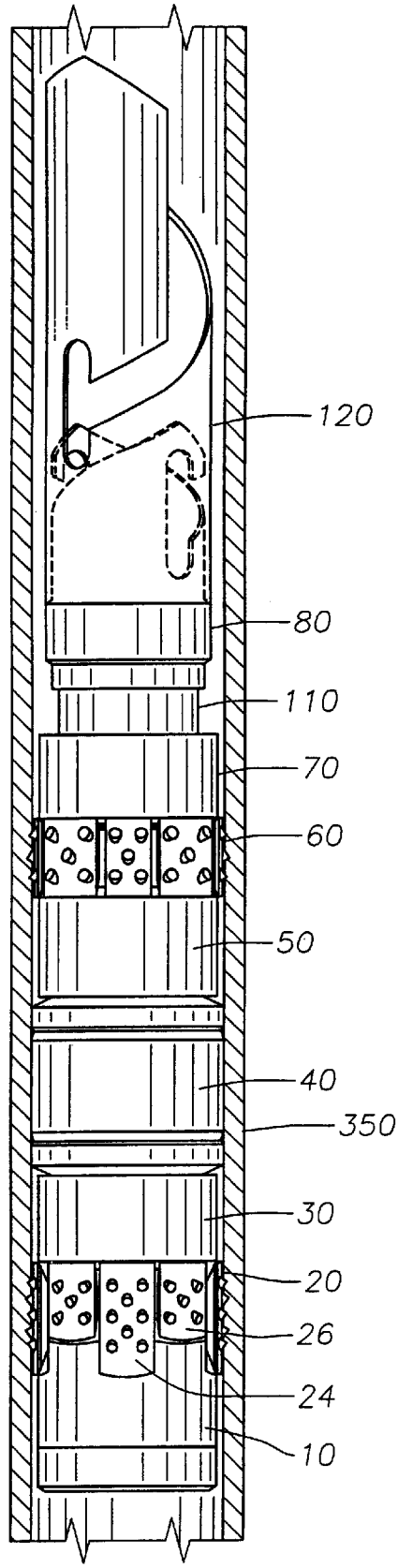
FIG. 6 is a side view of the tool shown in FIG. 1, in place in a casing and with the slips radially expanded.

Referring to FIGS. 1 and 6, the ram is then actuated while the stinger remains in engagement with scoop 215. The stinger prevents scoop 215, mandrel 110 and bottom sub 10 from shifting axially, while a sleeve 220 driven by the ram engages annular bearing surface 78 of lock ring retainer 70 and drives it axially toward bottom sub 10, shearing pins 56 and 36 in the process. This causes engagement of camming surface 77 with camming surface 67, 61 with 51, 31 with 21, and 111 with 27. As lock ring retainer 70 advances toward bottom sub 10, upper and lower slip rings are driven radially outward. This initially causes the rings 62 and 22 to break and separate into a plurality of pads, which then advance radially outwardly until the carbide inserts dig into and engage the inner surface of the casing string 350. At the same time, packer assembly 40 is squeezed between compression faces 32 and 52 and forced radially outwardly against the inside of the casing.

Once the desired compressive force is applied to the tool, the stinger is latched down by advancing a conventional collet mechanism until it engages lower annular channel 115. In the locked-down position, pins 204, 208 engage the lower ends 122, 92 of their respective slots. At this point the whipstock is wholly supported and fixed at the desired depth and azimuthal orientation and milling can begin. If or when it is desired to remove the whipstock from the whipstock support, the collet mechanism can be released from the bottom sub and the stinger can be disengaged from scoop 215 by left-rotation combined with backing out.

In wireline operations, the foregoing steps are accomplished in a slightly different order. Specifically, the tool 100 is run into the hole to the desired depth and set, using an electrically actuated setting mechanism to apply a downward force on lock ring retainer 70, as described above. Once the desired compressive force has been applied to slips 20, 60 and the tool is set, the azimuthal orientation of scoop 215 is determined by a conventional wireline survey means, by telemetry or any other suitable mechanism. Using the orientation data in combination with the azimuthal location of the target formation, the stinger and whipstock are assembled at the surface so as to achieve the desired azimuthal orientation of the whipstock. The assembled stinger and whipstock are then run into the hole. When the stinger encounters scoop 215, it is guided by surfaces 127 and/or 126 into the correct azimuthal orientation.

Again, a collet mechanism is used to lock the stinger into engagement with scoop 215 during milling. As described above, the collet mechanism can be released from tool 100 by conventional means. In an alternative embodiment, a modified collet mechanism can engage channel 85 in lower hook portion 80 during wireline run-in.

In either case, the pin-and-hook configuration of the present device allows a much greater load to be borne by the present tool that has heretofore been possible. For example, as much as several thousand feet of pipe can be suspended from tool 100. The load limit is determined by the mechanical strength of pins 204, 208 and inner and outer hook portions 80, 120.

Also in accordance with the present invention, the tongue and groove configuration of the lower slip assembly ensures that no relative rotation will occur between slip member 20 and bottom sub 10. Hence, the precise azimuthal orientation of the whipstock is more likely to be maintained throughout the milling operation, even in the presence of significant torque.

Extreme Service Applications

Figure 7:
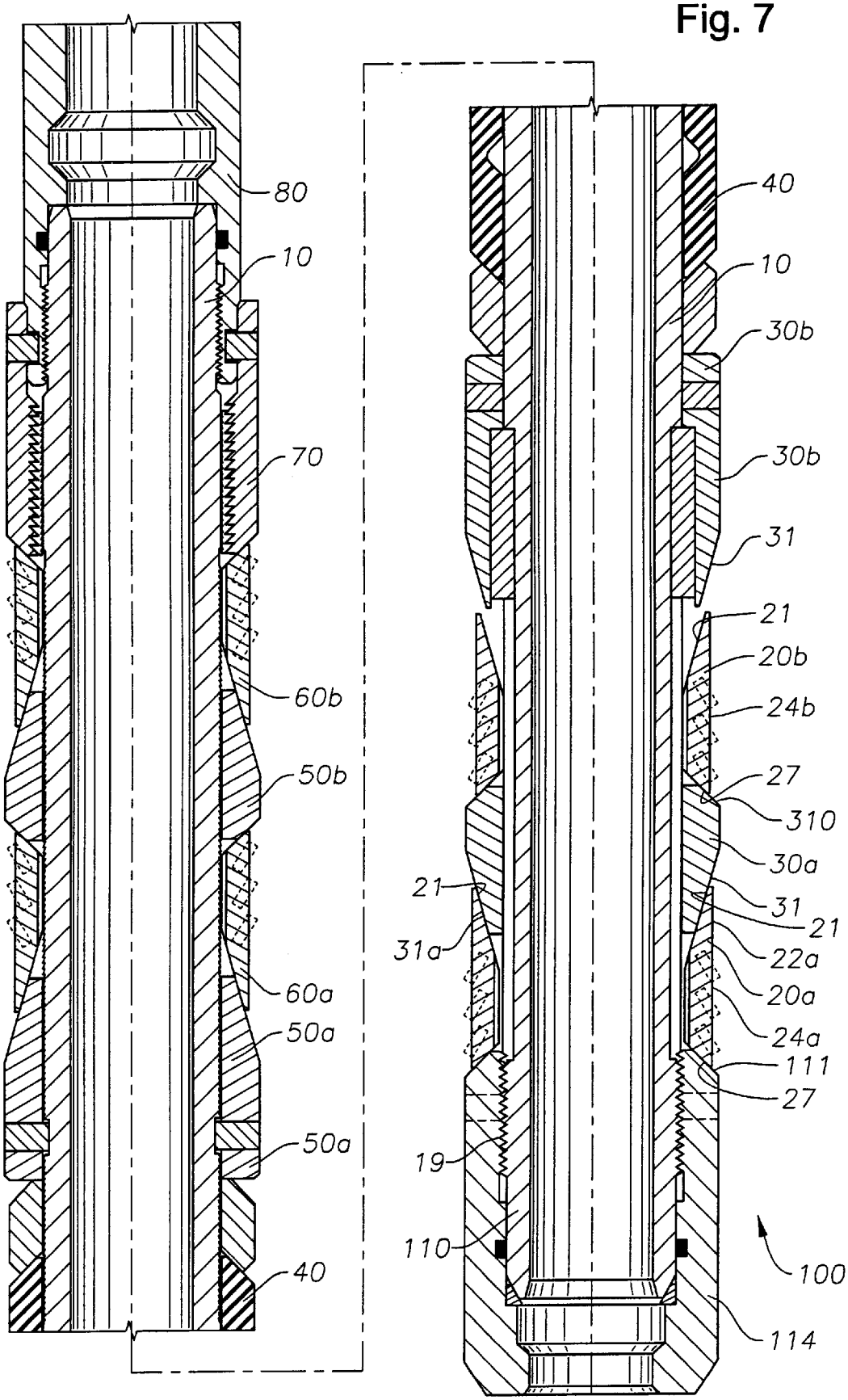
FIG. 7 is a partial cross-sectional view of an alternate embodiment of the present invention.

Referring to FIGS. 1 and 7, an alternate embodiment of the present invention for extreme service applications, such as high pressure environments, employs a plurality of slip members both above and below the packing element. Like the embodiment described above, the extreme service tool 100 includes a mandrel 110 with a bottom end that is threaded at threads 19 to bottom sub 114. Bottom sub 114 has a camming surface 111, above which are disposed a first lower slip member 20*a*, a first lower cone 30*a*, a second lower slip member 20*b*, and a second lower cone 30*b*. First and second lower slip members 20*a*, 20*b* preferably resemble lower slip member 20 described above with respect to FIG. 1, with the exception that the sections 24*a*, 24*b* thereof are not alternating tongue and groove sections and are instead all the same length. Each section 24*a*, 24*b* preferably includes a lower camming surface 27 at its lower end and an upper camming surface 21 on its upper end. The lower camming surface 27 of first lower slip 22*a* engages a corresponding camming surface 111 on bottom sub 114. Camming surfaces 27 and 111 can be either planar or frustoconical, with a preferred embodiment comprising planar camming surfaces 27 and a frustoconical camming surface 111.

First lower cone 30*a* is disposed above first lower slip member 20*a* and includes a lower camming surface 31 at its lower end to engage camming surface 21*a* of first lower slip 20*a*. Unlike the embodiment of FIG. 1, first lower cone 30*a* has a preferably frustoconical upper camming surface 310.

The alternate embodiment of the present invention adds second lower slip member 20*b* above first lower cone 30*a*. Like first lower slip member 20*a*, second lower slip member 20*b* has lower carnming surfaces 27, which engage the upper camming surface 310 of first lower cone 30*a*. Second lower cone 30*b* is disposed above second lower slip member 20*b* and engages upper camming surfaces 21 thereof in the manner described above.

Packer assembly 40 is disposed above second lower cone 30*b*. The double slip member and cone arrangement described in the preceding paragraphs is mirrored above packer assembly 40. Specifically, first upper cone 50*a* is above packer assembly 40, first upper slip member 60*a* is disposed above first upper cone 50*a*, second upper cone 50*b* is disposed above first upper slip 60*a* and second upper slip member 60*b* is disposed above second upper cone 50*b*. A lock ring retainer 70 is above second upper slip member 60*b* and operates in the manner described above.

The operation of the alternate embodiment of the invention is similar to that of the embodiment shown in FIG. 1, but with more than one slip on each side of packer assembly 40 being set into the casing. The distribution of the load across a plurality of slip elements and at different heights above and below the packing element distributes the load over more points on the casing, thereby lowering the localized stress on the casing wall and reducing the chance of failure.

Figure 8:
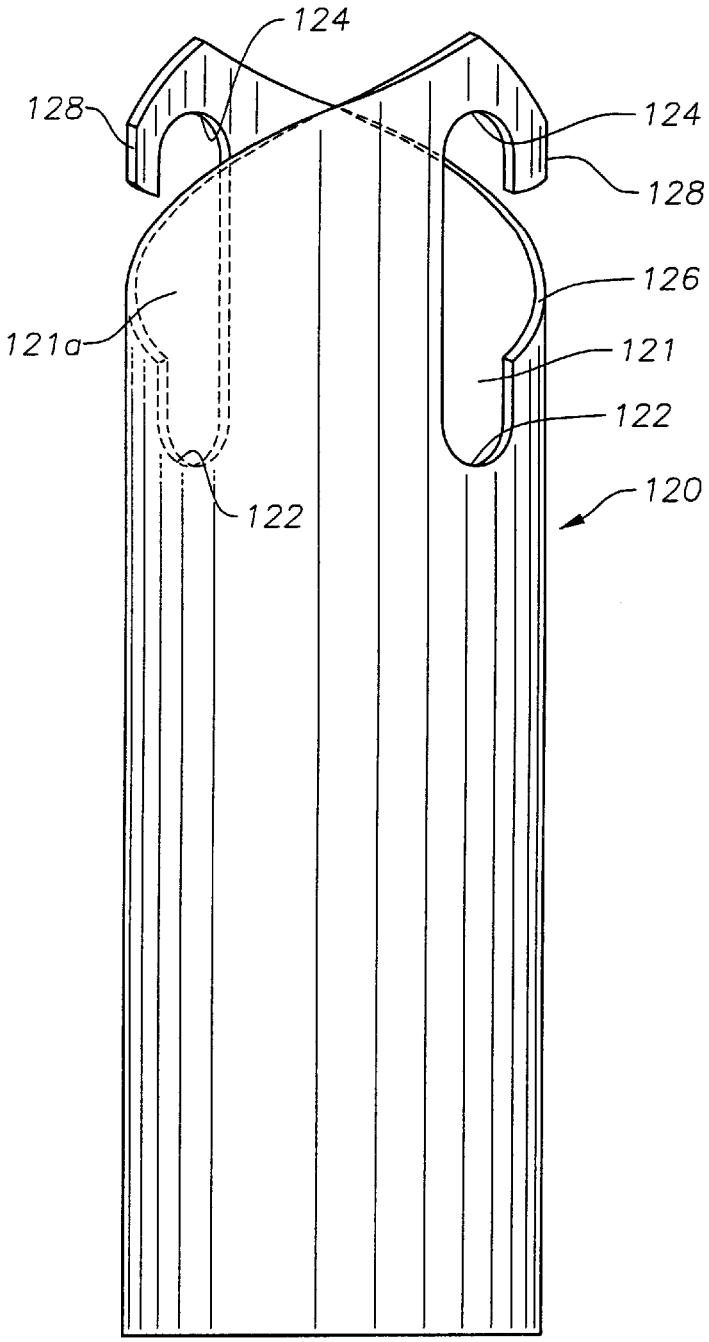
FIG. 8 is a partial side view of the scoop that engages the lock ring retainer shown in FIG. 7.
Figure 9:
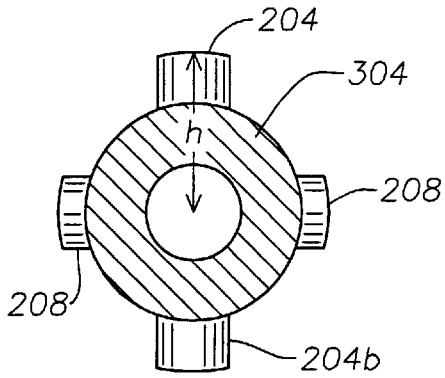
FIG. 9 is a cross-sectional view of the latch-down mechanism shown in FIG. 7.

Referring now to FIGS. 1, 8 and 9 in another alternative embodiment of the invention, the outer hook portion 120 of FIG. 1 is modified to include two elongate slots 121, which each include a lower slot end 122, an upper slot end 124, a helical inclined edge 126, and a substantially longitudinal guide surface 128. The modification of outer hook portion 120 allows distribution of the load over two slots and two pins instead of the single slot and pin of FIG. 1. FIG. 8 shows only outer hook portion 120, with inner hook portion 80 being omitted for ease of understanding. Because orientation of the high pressure packer is not likely to be critical, two such slots can be used, whereas a single slot was preferred in the preferred embodiment of the invention so as to ensure a single, desired orientation. Correspondingly, as shown in FIG. 9, a second pin 204*a* is located opposite pin 204 and engages the second slot 121.

While the present invention has been described in terms of use with a permanent packer, it will be understood that it is suitable for use with a retrievable packer, or with other similar equipment. For example the present scoop can be used in combination with an anchor, a permanent packer, or a retrievable packer.

While the present invention has been described and disclosed in terms of a preferred embodiment, it will be understood that variations in the details thereof can be made without departing from the scope of the invention. For example, the number of pins, the configuration of the scoop surfaces, the number of slip pads and the lengths and relationships of various components, the interaction between the invention and conventional components of the tool, and materials and dimensions of the components can be varied.

Likewise, it will be understood that the slip assembly of the present invention and the scoop of the present invention can each be used in combination with other downhole tools. For example, the present slip assembly is suitable for use with a no-turn tool.

What is claimed is:

1. A packer, comprising:

a radially expandable packing element;

a first plurality of slip members disposed at distinct distances below the packing element;

a second plurality of slip members disposed at distinct distances above the packing element;

a setting cone disposed adjacent to each slip member for engaging and setting said slip member; and wherein each slip member comprises a means for releasably connecting a plurality of slip pads.

2. A packer, comprising:

a radially expandable packing element;

a first plurality of slip members disposed at distinct distances below the packing element;

a second plurality of slip members disposed at distinct distances above the packing element;

a setting cone disposed adjacent to each slip member for engaging and setting said slip member; and wherein each slip member comprises a frangible ring connecting a plurality of slip pads.

3. The packer according to claim 2 wherein said slip pads are equal axial length.

4. The packer according to claim 2 wherein at least one of said slip pads includes casing engaging teeth.

5. The packer according to claim 2 wherein each setting cone includes at least one frustoconical camming surface.

6. The packer according to claim 2 wherein at least one setting cone above said packer and at least one setting cone below said packer includes two frustoconical camming surfaces.

7. A method for setting a packer, comprising:

(a) including on the packer a radially expandable packing element and at least two radially expandable casing-engaging slip members above the packing element and at least two radially expandable casing-engaging slip members below the packing element, wherein each slip member comprises a frangible ring connecting a plurality of slip pads;

(b) positioning the packer at a desired location in a borehole; and (c) expanding the packing element and the slip members such that the casing is engaged at least two heights above the packing element and at least two heights below the packing element.

8. The method according to claim 7 wherein step (c) is accomplished by applying a compression force to the packer.

9. A hook assembly for use downhole, comprising:

an outer hook member including a pair of helical surfaces, each of which terminates in a pin engaging slot, said pin engaging slot including upper and lower closed ends; and an inner hook member including a pair of helical surfaces, each of which terminates in a pin engaging slot, said pin engaging slot including upper and lower closed ends.

10. The hook assembly according to claim 9 wherein said outer hook member and said inner hook member are concentrically engaged and axially positioned relative to each other such that when one pin engaging slot is engaged by a pin, all of said pin engaging slots are engaged by a pin.

11. A packer for use in extreme service applications, comprising:

a radially expandable packing element;

a first plurality of slip members disposed at distinct distances below the packing element;

a second plurality of slip members disposed at distinct distances above the packing element;

a setting cone disposed adjacent to each slip member for engaging and setting said slip member; and a hook assembly affixed to the packer, said hook assembly comprising:

an outer hook member including a pair of helical surfaces, each of which terminates in a pin engaging slot, said pin engaging slot including upper and lower closed ends; and an inner hook member including a pair of helical surfaces, each of which terminates in a pin engaging slot, said pin engaging slot including upper and lower closed ends.

12. The packer according to claim 11 wherein each slip member comprises a frangible ring having a plurality of slip pads thereon.

13. The packer according to claim 12 wherein said slip pads are equal axial length.

14. The packer according to claim 11 wherein at least one of said slip pads includes casing engaging teeth.

15. The packer according to claim 11 wherein each setting cone includes at least one frustoconical camming surface.

16. The packer according to claim 11 wherein at least one setting cone above said packer and at least one setting cone below said packer includes two frustoconical camming surfaces.

17. The packer according to claim 16 wherein said outer hook member and said inner hook member are concentrically engaged and axially positioned relative to each other such that when one pin engaging slot is engaged by a pin, all of said pin engaging slots are engaged by a pin.

* * * * *